United States Patent [19]

Cohen

[11] 3,937,322

[45] Feb. 10, 1976

[54] PACKAGE FOR DISPOSABLE PIPETTE TIPS

[75] Inventor: Jules Barry Cohen, Brooklyn, N.Y.

[73] Assignee: Medical Laboratory Automation, Inc., Mount Vernon, N.Y.

[22] Filed: June 17, 1971

[21] Appl. No.: 154,143

[52] U.S. Cl. ..... 206/216; 206/486; 206/499

[51] Int. Cl.[2] ..... B65D 79/00; B65D 85/62

[58] Field of Search..... 206/65 K, 65 A, 223, 216; 73/425.4 P; 128/233; 225/93, 96.5

[56] References Cited

UNITED STATES PATENTS

| | | | |
|---|---|---|---|
| 1,326,519 | 12/1919 | McLaren | 206/65 K |
| 2,142,567 | 1/1939 | Levy | 206/65 K |
| 2,489,035 | 11/1949 | Jones | 128/233 X |
| 3,039,881 | 6/1962 | Shapiro | 206/65 K X |
| 3,127,991 | 4/1964 | Burnett | 229/17 R X |
| 3,494,201 | 2/1970 | Roach | 73/425.6 |
| 3,499,825 | 3/1970 | Falcone et al. | 220/97 C X |

FOREIGN PATENTS OR APPLICATIONS

| | | | |
|---|---|---|---|
| 1,362,603 | 4/1964 | France | 206/65 A |

*Primary Examiner*—Leonard Summer
*Attorney, Agent, or Firm*—William P. Keegan

[57] ABSTRACT

A package of disposable pipette tips in which the tips are supported on trays and trays with tips are stacked one upon another such that the tip of one tray project into but do not touch the tips of the tray below. A tip removal member is mounted on the carton.

3 Claims, 11 Drawing Figures

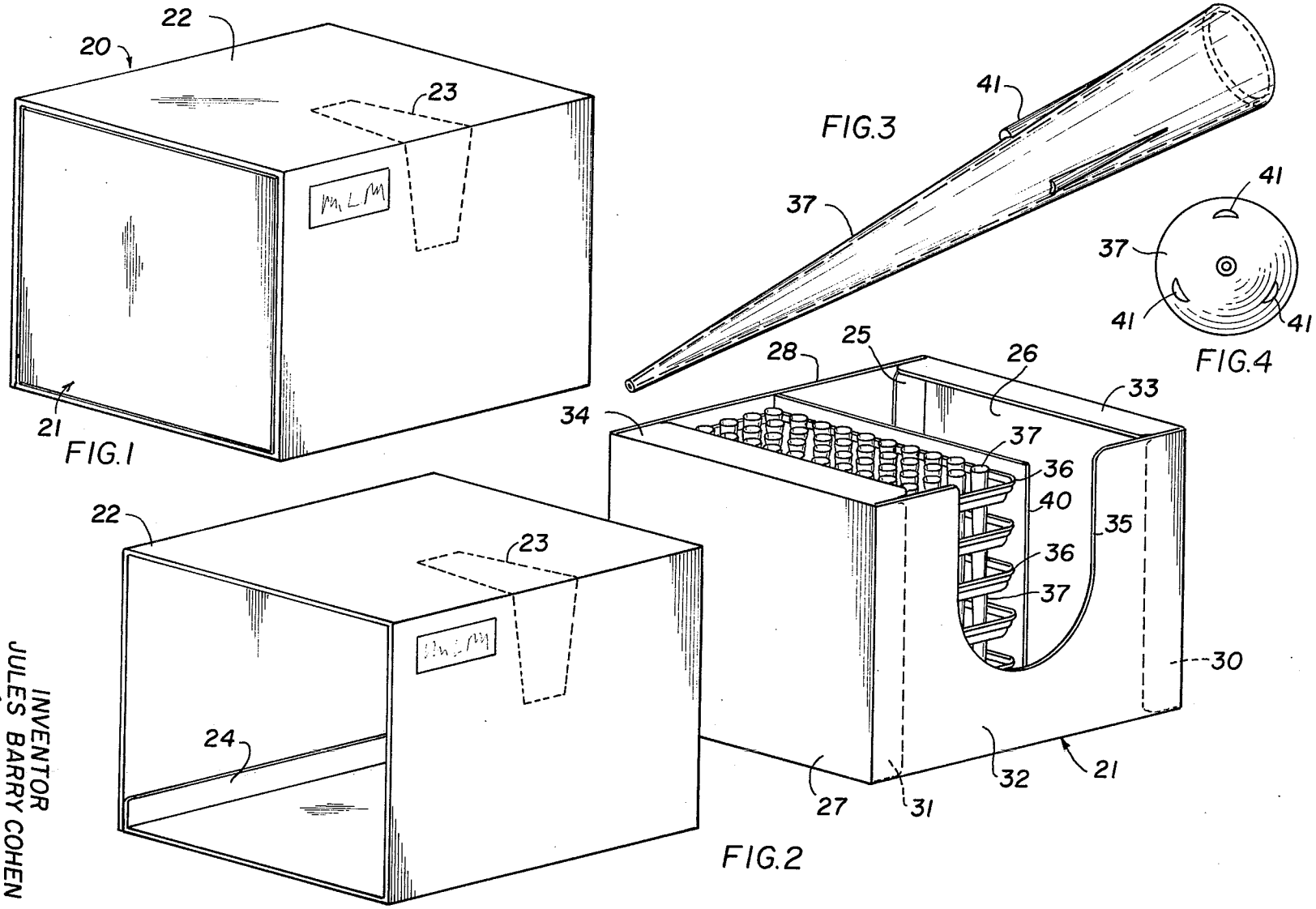
INVENTOR
JULES BARRY COHEN
BY William P. Keegan
ATTORNEY

INVENTOR
JULES BARRY COHEN
BY William P. Keegan

INVENTOR
JULES BARRY COHEN

BY William P. Keegan

PACKAGE FOR DISPOSABLE PIPETTE TIPS

This invention relates to disposable tips for pipettes and to packaging means for such tips.

With the introduction of disposable items in the medical equipment supply field there has come a need for convenience packages for such items. By convenience, I mean that an appropriate number (depending on the item and its rate of use) of items must be packaged in a compact volume, the items must be readily accessible to the technician or other person using the item, the item preferably is to be put in use without the necessity of a technician handling the item, particularly if the item is to contact biological fluids or the like, and if possible the original package is to serve as a receptacle for the disposable item after its use.

Accordingly, the object of the present invention is to provide a package for disposable pipette tips which has the foregoing convenience features.

In carrying out the invention, there is provided a disposable pipette tip having a plurality of circumferentially spaced supporting ribs that support the tips as they are stacked one inside another without the walls of one tip contacting the interior of the tip into which it is stacked. The tips are placed in apertured trays such that the tips project through the tray but are supported thereon by their supporting ribs. When the trays are stacked one above another, the top of the pipette tips support the tray next above, while the downwardly projecting portion of the tip fits freely within the pipette tip stored in the tray next below. One or more stacks of pipette tip loaded trays are placed in an open top carton and this carton, in turn, is placed in a conventional flap top box or a sleeve type open ended box. A tip removing member is provided for removing a tip from a pipette after it has been used and depositing it in the original carton and box from which the stacked tip trays have been removed.

Features and advantages of the invention may be gained from the foregoing and from the description of a preferred embodiment of the invention which follows.

In the drawings:

FIG. 1 is an isometric view of the pipette tip package;

FIG. 2 is an isometric exploded view showing the tip carton removed from a sleeve type box;

FIG. 3 is a perspective view of a disposable pipette tip;

FIG. 4 is a bottom view of the pipette tip;

Figure 5:
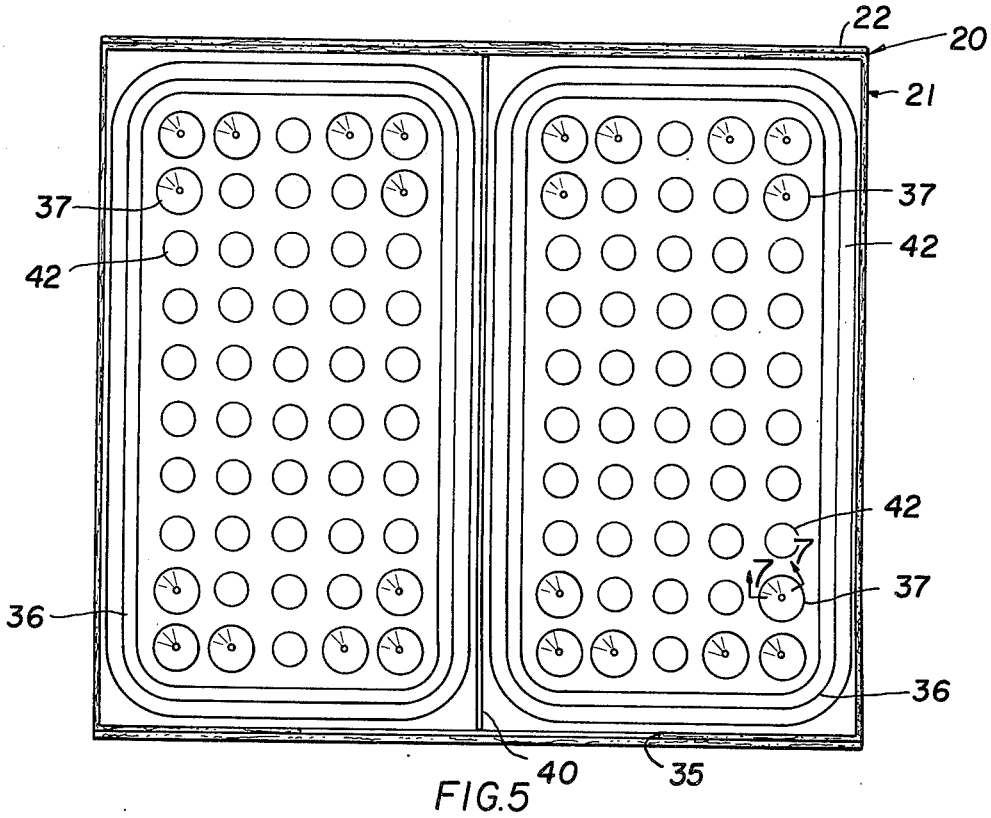
FIG. 5 is a top plan view of stacks of pipette tip trays with tips in their carton.

Reference is now made to the drawings wherein FIG. 1 shows the disposable tip package 20 as it would appear when filled and ready for marketing. of course, the identification and other information normally printed on a package is not shown. Package 20 is seen to consist of an inner carton 21 and an other sleeve type box 22 that slides over carton 21. Carton 21 could be placed in a regular flap top box if desired, but here the preference is for a sleeve type box. Box 22 is provided with perforated score lines 23 so that an opening conforming to the outline of the score lines can be provided for a purpose later to be discussed.

In FIG. 2 box 22 is seen to be an open ended rectangular sleeve. It is formed by scoring a flat sheet of cardboard and folding it to the shape shown; a flap 24 is provided and it can be glued to the rear wall of the box. Carton 21 is seen to be essentially an open top container that can slide into either open end of box 22. Carton 21 also is formed by scoring a flat sheet of cardboard at what will be the edges of the carton. The flat sheet is shaped like a block cross with the two opposing arms that will be the ends being provided with three flaps along their open edges. In this way, when the container is formed by folding into a box shape, flap 25 on end 26 and its counterpart on end 27 can be glued to front wall 32. Flaps 33 and 34 simply fold over and partially close the top of the container; they help to keep dust or other contaminents out of the package when carton 21 is slipped into box 22. Front wall 32 of the carton is provided with a cut out 35 as shown.

A stack of trays 36 with disposable pipette tips 37 are illustrated in one half of carton 21. A similar stack of trays and tips (not shown) would be packed in the other half of carton 21 with a sheet of cardboard 40 separating the two stacks. Or the carton could be of smaller size and hold only a single stack of trays and tips. The disposable tips 37 are simply hollow, generally conically shaped members each formed with a number of lengthwise ribs 41 spaced around its outer surface. The tips 37 are preferably clear polypropylene, free of voids, inclusions and discolorations.

Figure 6:
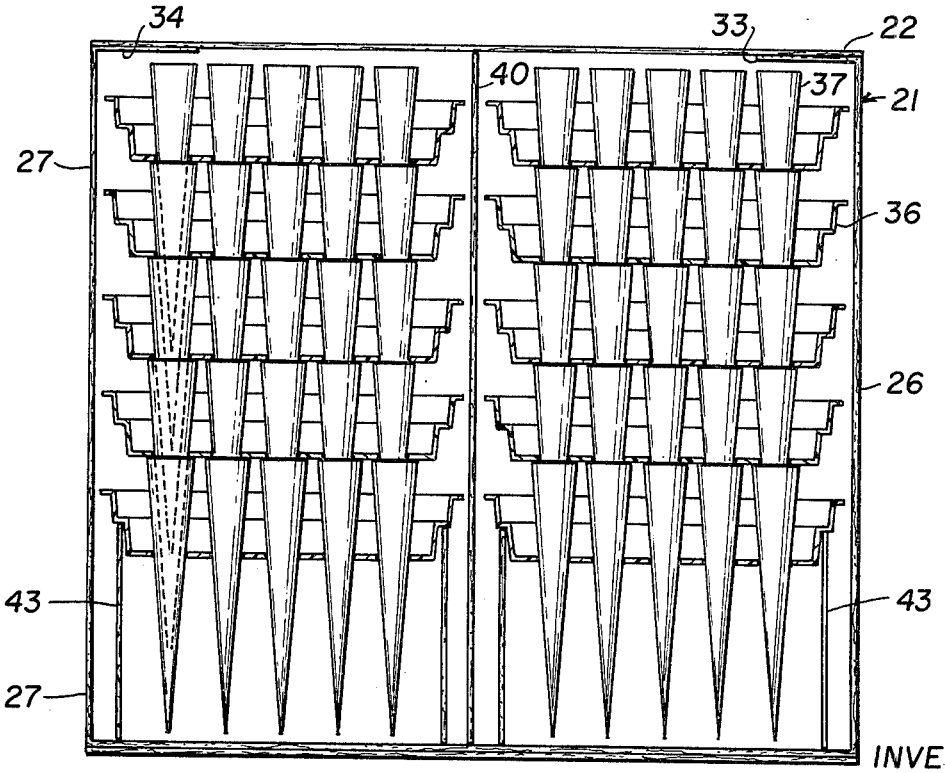
FIG. 6 is a front elevational view of stacks of pipette tip trays and tips in their carton with the front wall of the carton removed and the trays shown in section.
Figure 10:
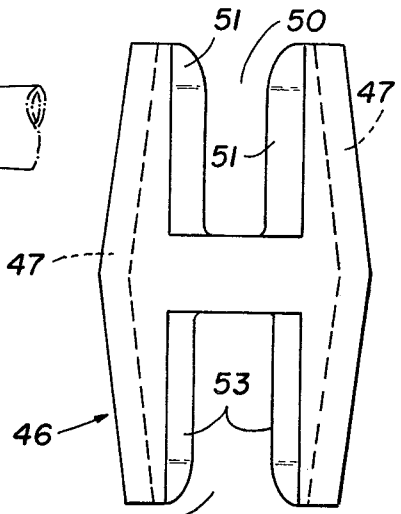
FIG. 10 is a sectional view taken along line 10—10 of FIG. 8.
Figure 11:
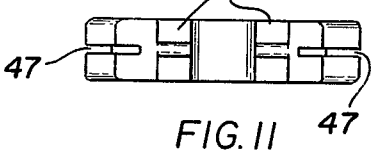
FIG. 11 is a bottom view of the tip remover member.
Figure 9:
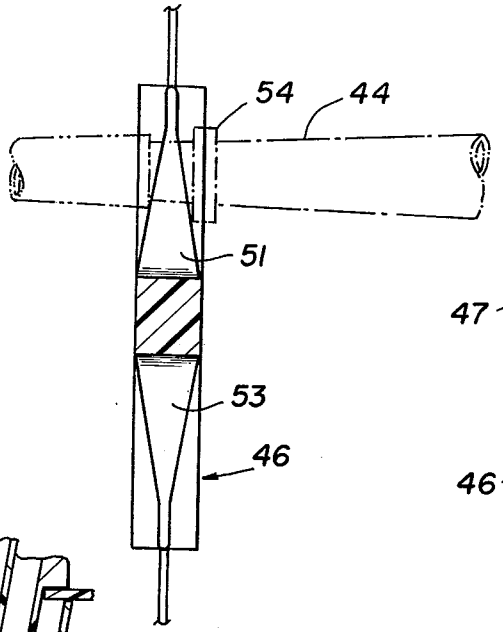
FIG. 9 is a front elevational view of the tip remover member.
Figure 7:
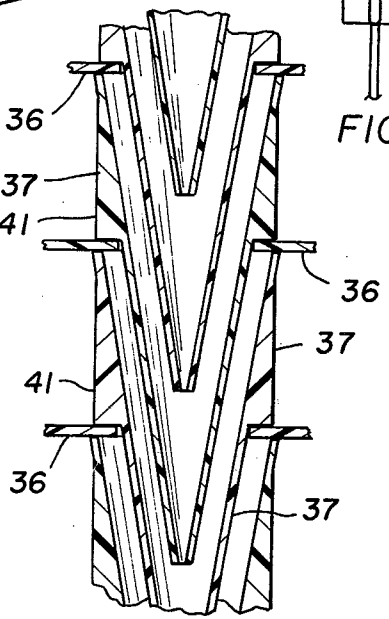
FIG. 7 is an enlarged detail view showing especially how the disposable tips rest one inside another.

Attention is now directed to FIGS. 5, 6, and 7, and especially to the latter two figures, for a description of the compact manner in which the disposable tips are packaged and the manner in which they can be put in use directly from their package. FIG. 5 being a top plan view of disposable tip package 20 with the top of box 22 removed is rather self-explanatory. It shows two stacks of trays 36 with a few representative tips 37 illustrated. The trays 36 are preferably formed of white styrene with fifty apertures provided therein for fifty of the disposable tips 37. The apertures 42 are dimensioned such that when a tip 37 is placed in one of them it will come to rest when the bottom surface or shoulders of ribs 41 contact the top surface of the tray.

If one looks at FIG. 6, it will be seen that the bottom tray 36 in carton 21 sits on a member 43 which supports the tray a distance above the bottom of the carton such that disposable tips in the tray do not touch the bottom of the carton. Trays 36 above the bottom tray are supported by the disposable tips in the trays next below. It will be observed (See FIG. 7) that the ribs 41 formed on the disposable tips extend far enough down the sides of the tips to separate two adjacent trays a distance far enough that the portion of one tip 37 extending through one tray 36 fits into the tip 37 immediately below without touching the interior wall of the lower tip. With such an arrangement there is no possibility of the tips being wedged one within another. Thus when it is deisred to remove a tip 37 from the carton 21, a pipette 44 is simply pressed down into the tip so that the tapered pipette barrel frictionally engages the tapered interior wall of tip 37, and the tip removed from the tray. As noted above, a tip will never be stuck in the tip immediately below and its easy removal is always assured. When all of the tips 37 in the topmost tray have been used, the tray is discarded thereby exposing for use all of the tips in the next tray. Thus, when using disposable pipette tips packaged as taught by the present invention, there is no need for the technician to touch the disposable tips before their use in a pipetting operation.

Figure 8:
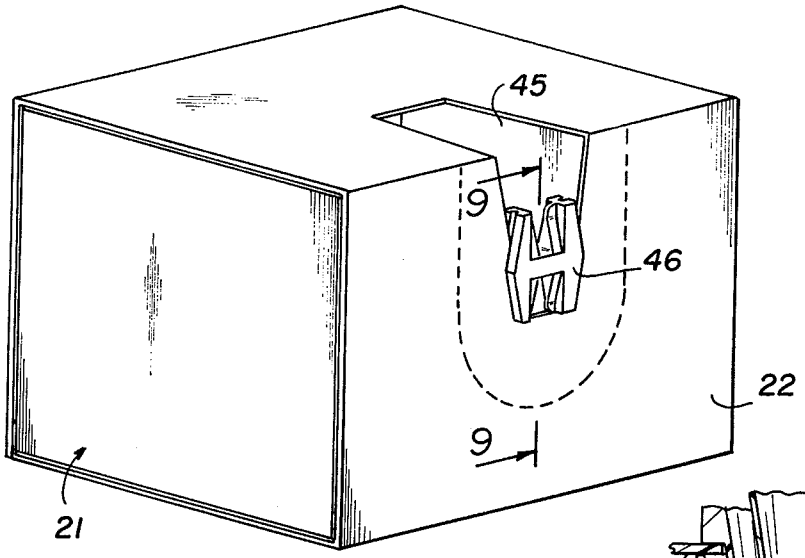
FIG. 8 is an isometric view of an empty pipette tip carton and box with a tip remover member in place.

In FIG. 8 box 22 is shown with the part outlined by perforated score lines 23 torn out to provide an opening 45 in the top and the front wall of the box. The opening thus provided will align with the open top and the cut out part 35 of an empty carton 21 placed in box 22. Thus, a receptacle for used disposable tips 37 is provided. It will be noted that the part of opening 45 in the front wall of box 21 is trapezoidal in shape with tapering sides. This is to accomodate a tip removal member 46.

De-tipping member 46 is a generally H-shaped piece, preferably nylon, that is provided at its outer edges with lengthwise grooves 47 that taper outwardly towards the center of member 46. The upper space 50 between the ascending arms of member 46 is provided with a pair of wedges 51 spaced apart one distance, while the lower space 52 between the descending arms of member 46 is provided with a pair of wedges 53 spaced apart a distance greater than the spacing between wedges 51. The reason for the different spacings will be mentioned hereinafter. While member 46 has been disclosed by reference to its component parts, it is to be understood that, preferably, member 46 is integrally formed.

In use, member 46 is inserted in opening 45 with the sides of the opening fitting into grooves 47. If a narrow pipette 44 is being used, member 46 will be inserted in opening 45 so that the narrowly spaced apart wedges 51 will be pointed towards the top of box 22 whereas when a wider pipette is being used, member 46 will be inserted in opening 45 so that wedges 53 will be pointed upwardly. With member 46 in place, it is a simple procedure to remove a disposable tip 37 from a pipette 44. The pipette with disposable tip mounted thereon is positioned in opening 45 so that the tip is within box 22 and wedges 51 between the top of tip 37 and an annular ring 54 formed on the pipette barrel. Now a simple downward movement of the pipette wedges the tip 37 off the pipette barrel whereupon it falls into box 22. As when the tip was placed on the pipette barrel, there is no need for the technician to touch the tip when removing and discarding it.

Having thus described my invention, it is to be understood that many apparently different embodiments thereof can be conceived without departing from its spirit and scope, and, therefore, it is intended that the foregoing description and the accompanying drawings be interpreted as illustrative rather than in a limiting sense.

What is claimed is:

1. A package of pipette tips comprising a first tray having a plurality of apertures through which pipette tips can project, a first group of tapered pipette tips projecting through the apertures of said first tray, each tip having abutment means projecting outwardly from the outer surface thereof to support the tip on said first tray so that a part of said tip projects through its associated aperture, a second tray having a plurality of apertures through which pipette tips can project, said second tray being supported above said first tray by said first group of pipette tips, a second group of tapered pipette tips projecting through the apertures of said second tray, each tip having abutment means projecting outwardly from the outer surface thereof to support the tip on said second tray so that a part of said tip projects through its associated aperture, the location of said abutment means and the taper of said pipette tips being such that the tips carried by said second tray project into but do not touch the internal walls of the tips carried by said first tray, carton means containing said stacked trays of pipette tips, said carton means having means to accommodate a member for removing pipette tips from frictional engagement with a pipette, and a tip removal member mounted on said carton means, said tip removal member having means mounting said member on said carton means and a rectangularly shaped open-ended slot for receiving the end of a pipette with a removable tip thereon, the thickness of said member at the bottom of said slot being greater than at the top of said slot.

2. A package of pipette tips according to claim 1 wherein the accommodating means on said carton means is a tapered cut-out, and the mounting means on said tip removal member are grooves on both edges of said member into which the edges of the carton means cut-out fit.

3. A package of pipette tips according to claim 1 wherein said tip removal member has a second open-ended slot similar to the first but having a different width.

* * * * *